US008619010B2

(12) United States Patent
Tanaka

(10) Patent No.: US 8,619,010 B2
(45) Date of Patent: Dec. 31, 2013

(54) IMAGE DISPLAY DEVICE AND IMAGE DISPLAY METHOD

(75) Inventor: Yuji Tanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 532 days.

(21) Appl. No.: 12/737,369

(22) PCT Filed: Jun. 1, 2009

(86) PCT No.: PCT/JP2009/059959
§ 371 (c)(1),
(2), (4) Date: Jan. 6, 2011

(87) PCT Pub. No.: WO2010/024009
PCT Pub. Date: Mar. 4, 2010

(65) Prior Publication Data

US 2011/0115827 A1 May 19, 2011

(30) Foreign Application Priority Data

Sep. 1, 2008 (JP) ..... 2008-223061

(51) Int. Cl.
*G09G 3/36* (2006.01)
*G09G 5/10* (2006.01)

(52) U.S. Cl.
USPC ..... 345/88; 345/102; 345/690

(58) Field of Classification Search
USPC ..... 345/87–104, 204, 690–697
See application file for complete search history.

(56) References Cited

U.S. PATENT DOCUMENTS

2005/0184952 A1 8/2005 Konno et al.
2005/0231457 A1 10/2005 Yamamoto et al.

(Continued)

FOREIGN PATENT DOCUMENTS

CN 1655024 8/2005
CN 1991967 7/2007

(Continued)

OTHER PUBLICATIONS

International Search Report.

(Continued)

*Primary Examiner* — Bipin Shalwala
*Assistant Examiner* — Steven Holton
(74) *Attorney, Agent, or Firm* — Harness, Dickey & Pierce, P.L.C.

(57) ABSTRACT

In at least one embodiment of the present invention, display is performed with high color reproducibility by a display device that performs area active drive. An LED output value calculating unit obtains LED data representing the luminances upon light emission of LEDs provided for respective areas, based on an input image. A display luminance calculating unit calculates a luminance image including display luminances for the respective areas, based on the LED data and a luminance spread filter. An LCD data calculating unit determines temporary light transmittances of display elements of a liquid crystal panel based on an input image delayed by a frame memory and the luminance image, and obtains liquid crystal data representing light transmittances such that, when a highest value of temporary light transmittances for respective colors exceeds 1, values obtained by dividing each of the temporary light transmittances by the highest value are used as light transmittances, and when the highest value does not exceed 1, the temporary light transmittances are used as light transmittances. By this, even if there is a color with insufficient luminance, since the ratio between the colors does not change, color reproducibility increases.

8 Claims, 5 Drawing Sheets

(56) References Cited

U.S. PATENT DOCUMENTS

| | | | | |
|---|---|---|---|---|
| 2007/0152926 | A1 | 7/2007 | Kwon | |
| 2007/0216616 | A1 | 9/2007 | Stessen et al. | |
| 2007/0268695 | A1 | 11/2007 | Seetzen | |
| 2007/0285382 | A1 | 12/2007 | Feng | |
| 2008/0111784 | A1* | 5/2008 | Tanaka et al. | 345/102 |
| 2008/0150880 | A1* | 6/2008 | Inuzuka et al. | 345/102 |
| 2008/0259217 | A1 | 10/2008 | Den Breejen et al. | |

FOREIGN PATENT DOCUMENTS

| | | | |
|---|---|---|---|
| CN | 101116133 | | 1/2008 |
| EP | 1 646 247 | | 4/2006 |
| EP | 2 207 059 | | 7/2010 |
| JP | 2002-099250 | A | 4/2002 |
| JP | 2005-258403 | | 9/2005 |
| JP | 2007322942 | A | 12/2007 |
| JP | 2008-501136 | | 1/2008 |
| JP | 2008015207 | A | 1/2008 |
| JP | 2008070558 | A | 3/2008 |
| JP | 2008-125049 | | 5/2008 |
| JP | 2008125049 | A | 5/2008 |
| RU | 2 207 656 | | 6/2003 |
| RU | 2 214 007 | | 10/2003 |
| RU | 44398 | | 3/2005 |
| WO | WO 2007/036851 | | 4/2007 |

OTHER PUBLICATIONS

Lin, Fang-Cheng et al., "39.4: Inverse of Mapping Function (IMF) Method for Image Quality Enhancement of High Dynamic Range LCS TVs," SID 07 Digest, pp. 1343-1346, 2007.

Russian Decision on Grant dated Oct. 28, 2011 and English translation thereof.

* cited by examiner

IMAGE DISPLAY DEVICE AND IMAGE DISPLAY METHOD

TECHNICAL FIELD

The present invention relates to an image display device and an image display method, and more particularly to an image display device having the function of controlling the luminance of a backlight (backlight dimming function), and an image display method for the device.

BACKGROUND ART

In image display devices having a backlight such as liquid crystal display devices, by controlling the luminance of the backlight based on an input image, the power consumption of the backlight can be suppressed and the image quality of a displayed image can be improved. In particular, by dividing a screen into a plurality of areas and controlling, based on an input image in an area, the luminances of backlight light sources provided for the area, a further reduction in power consumption and a further improvement in image quality can be achieved. A method of driving a display panel while thus controlling the luminances of backlight light sources based on an input image in each area is hereinafter referred to as "area active drive".

An image display device that performs area active drive uses, for example, LEDs (Light Emitting Diodes) of three RGB colors or white LEDs, as backlight light sources. For the luminances of LEDs provided for each area (luminances upon light emission), appropriate luminances are determined based on the highest value and mean value of the luminances of pixels in each area, etc. The determined luminances are provided to a backlight drive circuit as LED data. In addition, based on the LED data and an input image, display data (in the case of a liquid crystal display device, data for controlling the light transmittances of liquid crystals) is generated, and the display data is provided to a display panel drive circuit. In the case of a liquid crystal display device, the luminance of each pixel on a screen is the product of the luminance of light from a backlight and a light transmittance based on display data.

By driving the display panel drive circuit based on display data generated in the above-described manner, and driving the backlight drive circuit based on the above-described LED data, image display based on the input image is performed.

Note that in relation to inventions pertaining to this subject, the following prior art document is known. Japanese Patent Application Laid-Open No. 2002-99250 discloses an invention of a conventional image display device that includes an illumination luminance control unit that controls the luminance of illumination light for every plurality of regions based on an input image signal; and an image signal converting unit that converts the input image signal based on information of the luminances, thereby achieving an increase in dynamic range and a reduction in power consumption in image display.

PRIOR ART DOCUMENT

Patent Document

[Patent Document 1] Japanese Patent Application Laid-Open No. 2002-99250

SUMMARY OF THE INVENTION

Problems to be Solved by the Invention

In the above-described conventional image display device, however, in order to reduce power consumption, the luminance of illumination light is reduced. Hence, in the case of a liquid crystal display device, there may be a case in which, even if the light transmittances of liquid crystals are set to 1, the maximum value, since the luminance of illumination light is insufficient, display cannot be performed at a required luminance. Therefore, in the case in which illumination light includes, for example, three colors RGB (red, green, and blue) and the luminances of these lights are individually controlled, when the luminances of illumination lights of two colors at a maximum among the three colors are insufficient, the two colors may not be able to be displayed at their required luminances. At this time, since at least one color is displayed at a required luminance, a problem occurs that the luminance ratio between the colors at which display is originally supposed to be performed changes, thereby reducing color reproducibility (changing hue).

An object of the present invention is therefore to provide an image display device that performs area active drive and that is capable of performing display with high color reproducibility on a display unit, and an image display method for the device.

Solution to the Problems

According to a first aspect of the present invention, there is provided an image display device having a function of controlling a luminance of a backlight, the image display device comprising:

a backlight including a plurality of light sources that emit lights which are a plurality of primary colors;

a display panel including a plurality of sets of a plurality of display elements, each set displaying one pixel in a plurality of colors by allowing lights from the light sources to be transmitted therethrough;

a light-emission luminance calculating unit that divides an input image into a plurality of areas and obtains light-emission luminance data based on the input image, the input image including a plurality of pixels, each of which is formed by a plurality of colors, the light-emission luminance data representing luminances upon light emission of the light sources provided for the respective areas;

a display luminance calculating unit that determines display luminances based on the light-emission luminance data for the respective areas, the display luminances being highest luminances obtained by the respective display elements;

a display data calculating unit that obtains display data for controlling light transmittances of the display elements, based on the input image and the display luminances determined by the display luminance calculating unit;

a panel drive circuit that outputs, based on the display data, signals for controlling the light transmittances of the display elements to the display panel; and a backlight drive circuit that outputs, based on the light-emission luminance data, signals for controlling luminances of the light sources to the backlight, wherein when any of luminances for the respective colors forming a pixel in the input image is higher than a corresponding display luminance, the display data calculating unit obtains the display data based on values obtained by dividing each of the luminances for the respective colors forming the pixel in the input image by a same value, so that a light transmittance of a corresponding display element is 1 or less.

According to a second aspect of the present invention, in the first aspect of the present invention, the display data calculating unit divides the luminances for the respective colors forming a pixel in the input image by corresponding display luminances for the respective colors of the pixel, thereby calculating temporary light transmittances for the respective colors, and when a highest value of the temporary light transmittances for the respective colors exceeds 1, the display data calculating unit divides each of the temporary light transmittances for the respective colors by the highest value, thereby calculating light transmittances for the respective colors, and when the highest value is 1 or less, the display data calculating unit calculates the temporary light transmittances for the respective colors as light transmittances for the respective colors.

According to a third aspect of the present invention, in the second aspect of the present invention, the display data calculating unit includes:

a first division circuit that outputs the temporary light transmittances for the respective colors which are obtained by dividing the luminances for the respective colors forming a pixel in the input image by corresponding display luminances for the respective colors of the pixel;

a highest value selection circuit that selects a highest value of the temporary light transmittances for the respective colors which are outputted from the first division circuit, and outputs the highest value as a selected value when the highest value exceeds 1, and outputs 1 as a selected value when the highest value is 1 or less; and a second division circuit that outputs the light transmittances for the respective colors which are obtained by dividing each of the temporary light transmittances for the respective colors which are outputted from the first division circuit by the selected value outputted from the highest value selection circuit.

According to a fourth aspect of the present invention, in the first aspect of the present invention, the backlight includes light sources that respectively emit red, green, and blue which are three primary colors of light, and the display panel includes display elements that respectively control transmittances of red, green, and blue lights emitted from the light sources.

According to a fifth aspect of the present invention, in the fourth aspect of the present invention, the display panel includes liquid crystal elements as the display elements.

According to a sixth aspect of the present invention, there is provided an image display method for an image display device having a function of controlling a luminance of a backlight, and having a backlight including a plurality of light sources that emit lights which become a plurality of primary colors; and a display panel including a plurality of sets of a plurality of display elements, each set displaying one pixel in a plurality of colors by allowing lights from the light sources to be transmitted therethrough, the method comprising:

a light-emission luminance calculating step of dividing an input image into a plurality of areas and obtaining light-emission luminance data based on the input image, the input image including a plurality of pixels, each of which is formed by a plurality of colors, the light-emission luminance data representing luminances upon light emission of the light sources provided for the respective areas;

a display luminance calculating step of determining display luminances based on the light-emission luminance data for the respective areas, the display luminances being highest luminances obtained by the respective display elements;

a display data calculating step of obtaining display data for controlling light transmittances of the display elements, based on the input image and the display luminances determined in the display luminance calculating step;

a panel driving step of causing the display panel to control the light transmittances of the display elements, based on the display data; and a backlight driving step of causing the backlight to control luminances of the light sources, based on the light-emission luminance data, wherein in the display data calculating step, when any of luminances for the respective colors forming a pixel in the input image is higher than a corresponding display luminance, the display data is obtained based on values obtained by dividing each of the luminances for the respective colors forming the pixel in the input image by a same value, so that a light transmittance of a corresponding display element is 1 or less.

According to a seventh aspect of the present invention, in the sixth aspect of the present invention, in the display data calculating step, the luminances for the respective colors forming a pixel in the input image are divided by corresponding display luminances for the respective colors of the pixel, thereby calculating temporary light transmittances for the respective colors, and when a highest value of the temporary light transmittances for the respective colors exceeds 1, each of the temporary light transmittances for the respective colors is divided by the highest value, thereby calculating light transmittances for the respective colors, and when the highest value is 1 or less, the temporary light transmittances for the respective colors are calculated as light transmittances for the respective colors.

According to an eighth aspect of the present invention, in the seventh aspect of the present invention, the display data calculating step includes:

a first division step of outputting the temporary light transmittances for the respective colors which are obtained by dividing the luminances for the respective colors forming a pixel in the input image by corresponding display luminances for the respective colors of the pixel;

a highest value selecting step of selecting a highest value of the temporary light transmittances for the respective colors which are outputted in the first division step, and outputting the highest value as a selected value when the highest value exceeds 1, and outputting 1 as a selected value when the highest value is 1 or less; and a second division step of outputting light transmittances for the respective colors which are obtained by dividing each of the temporary light transmittances for the respective colors which are outputted in the first division step by the selected value outputted in the highest value selecting step.

Effect of the Invention

According to the first aspect of the present invention, when any of luminances for the respective colors forming a pixel in the input image is higher than a corresponding display luminance, display data is obtained based on values obtained by dividing each of the luminances for the respective colors by the same value, so that the light transmittance of a corresponding display element is 1 or less. Thus, even if the combined luminance for the respective colors decreases, display with high color reproducibility can be performed.

According to the second aspect of the present invention, temporary light transmittances for the respective colors are calculated, and when the highest value of the temporary light transmittances exceeds 1, each of the temporary light transmittances for the respective colors is divided by the highest value, thereby calculating light transmittances for the respective colors, and when the highest value is 1 or less, the temporary light transmittances for the respective colors are calculated as light transmittances for the respective colors as they are. Thus, display with high color reproducibility can be easily performed.

According to the third aspect of the present invention, display with high color reproducibility can be performed by a simple circuit configuration including first and second division circuits and a highest value selection circuit.

According to the fourth aspect of the present invention, by using three primary colors of light for the light sources and display colors; display with high color reproducibility can be performed by a generic configuration at low cost.

According to the fifth aspect of the present invention, by using widely-used liquid crystal elements, display with high definition and high color representation can be performed at low cost.

According to the sixth aspect of the present invention, the same effect as that obtained in the first aspect of the present invention can be provided by an image display method for an image display device.

According to the seventh aspect of the present invention, the same effect as that obtained in the second aspect of the present invention can be provided by an image display method for an image display device.

According to the eighth aspect of the present invention, the same effect as that obtained in the third aspect of the present invention can be provided by an image display method for an image display device.

MODE FOR CARRYING OUT THE INVENTION

An embodiment of the present invention will be described below with reference to the accompanying drawings.

<1. Overall Configuration and Overview of Operation>

Figure 1:
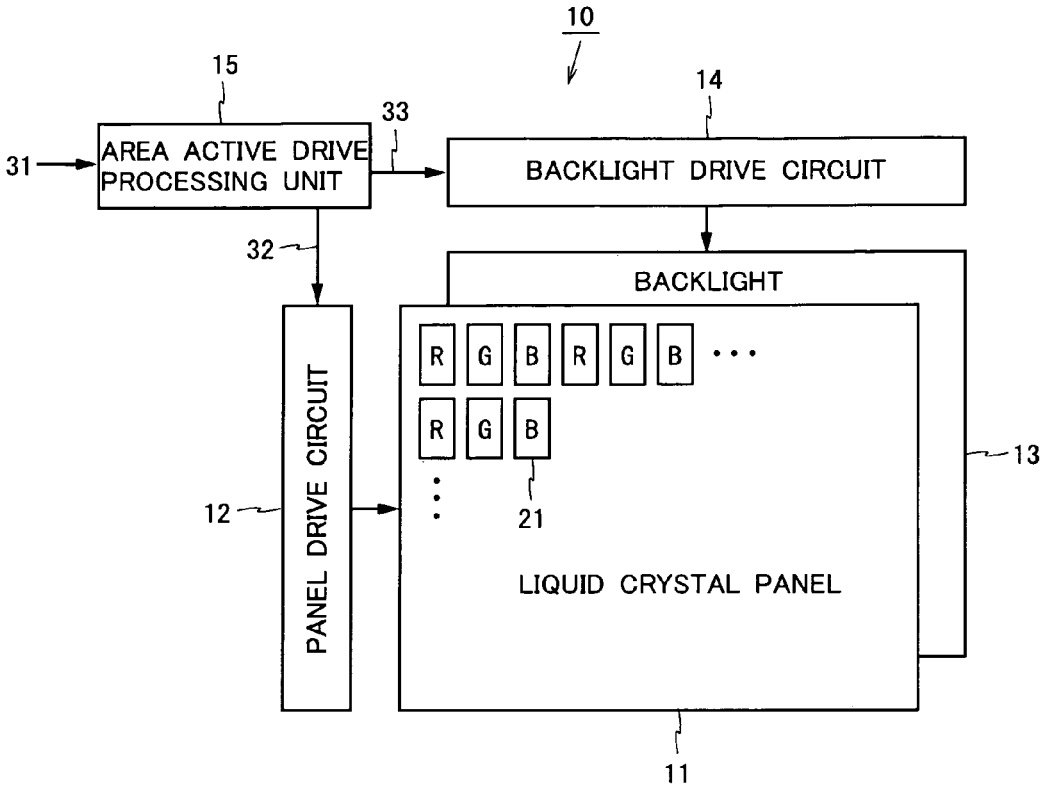
FIG. 1 is a block diagram showing a configuration of a liquid crystal display device according to an embodiment of the present invention.

FIG. 1 is a block diagram showing a configuration of a liquid crystal display device 10 according to an embodiment of the present invention. The liquid crystal display device 10 shown in FIG. 1 includes a liquid crystal panel 11, a panel drive circuit 12, a backlight 13, a backlight drive circuit 14, and an area active drive processing unit 15. The liquid crystal display device 10 performs area active drive where the liquid crystal panel 11 is driven while the luminances of backlight light sources are controlled based on an input image in each of a plurality of areas into which a screen is divided. In the following, m and n are integers greater than or equal to 2, p and q are integers greater than or equal to 1, and at least one of p and q is an integer greater than or equal to 2.

An input image 31 including an R image, a G image, and a B image is inputted to the liquid crystal display device 10. Each of the R image, the G image, and the B image includes the luminances of (m×n) pixels. The area active drive processing unit 15 obtains, based on the input image 31, display data used to drive the liquid crystal panel 11 (hereinafter, referred to as liquid crystal data 32) and backlight control data used to drive the backlight 13 (hereinafter, referred to as LED data 33) (details will be described later).

The liquid crystal panel 11 includes (m×n×3) display elements 21. The display elements 21 as a whole are arranged two-dimensionally such that 3 m display elements 21 are arranged in a row direction (a horizontal direction in FIG. 1) and n display elements 21 are arranged in a column direction (a vertical direction in FIG. 1). The display elements 21 include R display elements that allow red light to be transmitted therethrough, G display elements that allow green light to be transmitted therethrough, and B display elements that allow blue light to be transmitted therethrough. The R display elements, the G display elements, and the B display elements are arranged side by side in the row direction, and three R, G, and B display elements form one pixel.

The panel drive circuit 12 is a drive circuit for the liquid crystal panel 11. The panel drive circuit 12 outputs signals (voltage signals) for controlling the light transmittances of the display elements 21 to the liquid crystal panel 11, based on the liquid crystal data 32 outputted from the area active drive processing unit 15. The voltages outputted from the panel drive circuit 12 are written into pixel electrodes (not shown) in the respective display elements 21, and the light transmittances of the display elements 21 change according to the voltages written into the pixel electrodes.

Figure 2:
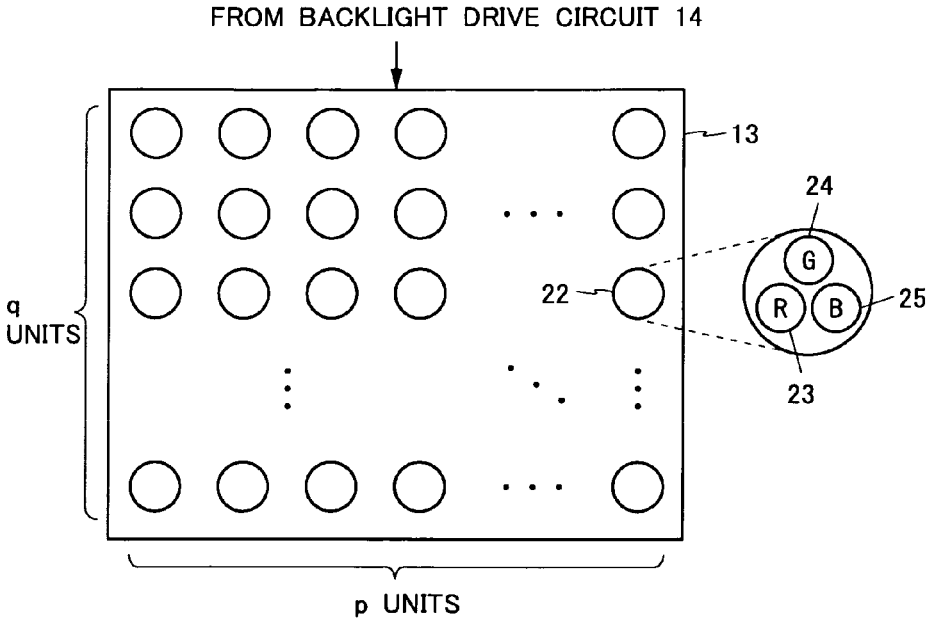
FIG. 2 is a diagram showing a detail of a backlight included in the liquid crystal display device according to the embodiment.

The backlight 13 is provided on the back side of the liquid crystal panel 11 and irradiates backlight light to the back of the liquid crystal panel 11. FIG. 2 is a diagram showing a detail of the backlight 13. As shown in FIG. 2, the backlight 13 includes (p×q) LED units 22. The LED units 22 as a whole are arranged two-dimensionally such that p LED units 22 are arranged in the row direction and q LED units 22 are arranged in the column direction. Each LED unit 22 includes one red LED 23, one green LED 24, and one blue LED 25. Lights emitted from three LEDs 23 to 25 included in one LED unit 22 hit a part of the back of the liquid crystal panel 11.

The backlight drive circuit 14 is a drive circuit for the backlight 13. The backlight drive circuit 14 outputs signals (voltage signals or current signals) for controlling the luminances of the LEDs 23 to 25 to the backlight 13, based on the LED data 33 outputted from the area active drive processing unit 15. The luminances of LEDs 23 to 25 are controlled independently of the luminances of LEDs inside and outside the unit thereof.

A screen of the liquid crystal display device 10 is divided into (p×q) areas, and one LED unit 22 is provided in one area. The area active drive processing unit 15 determines, for each of the (p×q) areas, based on an R image in the area, a luminance of a red LED 23 provided for the area. Likewise, a luminance of a green LED 24 is determined based on a G image in the area, and a luminance of a blue LED 25 is determined based on a B image in the area. The area active drive processing unit 15 determines luminances of all of the LEDs 23 to 25 included in the backlight 13, and outputs LED data 33 representing the determined LED luminances to the backlight drive circuit 14.

In addition, the area active drive processing unit 15 determines, based on the LED data 33, luminances of backlight lights in all of the display elements 21 included in the liquid crystal panel 11. Furthermore, the area active drive processing unit 15 determines light transmittances of all of the display elements 21 included in the liquid crystal panel 11 based on the input image 31 and the luminances of backlight lights, and outputs liquid crystal data 32 representing the determined light transmittances to the panel drive circuit 12. Note that detailed description of how to determine the luminances of backlight lights by the area active drive processing unit 15 will be provided later.

In the liquid crystal display device 10, the luminance of an R display element is the product of the luminance of red light emitted from the backlight 13 and the light transmittance of the R display element. Light emitted from one red LED 23 hits a plurality of areas around a corresponding area. Thus, the luminance of an R display element is the product of the sum of the luminances of lights emitted from a plurality of red LEDs 23 and the light transmittance of the R display element. Likewise, the luminance of a G display element is the product of the sum of the luminances of lights emitted from a plurality of green LEDs 24 and the light transmittance of the G display element, and the luminance of a B display element is the product of the sum of the luminances of lights emitted from a plurality of blue LEDs 25 and the light transmittance of the B display element.

According to the liquid crystal display device 10 configured in the above-described manner, suitable liquid crystal data 32 and LED data 33 are obtained based on an input image 31, the light transmittances of the display elements 21 are controlled based on the liquid crystal data 32, and the luminances of the LEDs 23 to 25 are controlled based on the LED data 33, whereby the input image 31 can be displayed on the liquid crystal panel 11. In addition, when the luminance of pixels in an area is low, by reducing the luminance of LEDs 23 to 25 provided for the area, the power consumption of the backlight 13 can be reduced. In addition, when the luminance of pixels in an area is low, by switching the luminance of display elements 21 provided for the area between smaller levels, the resolution of an image is increased, enabling to improve the image quality of a displayed image.

<2. Configuration of the Area Active Drive Processing Unit>

Figure 3:
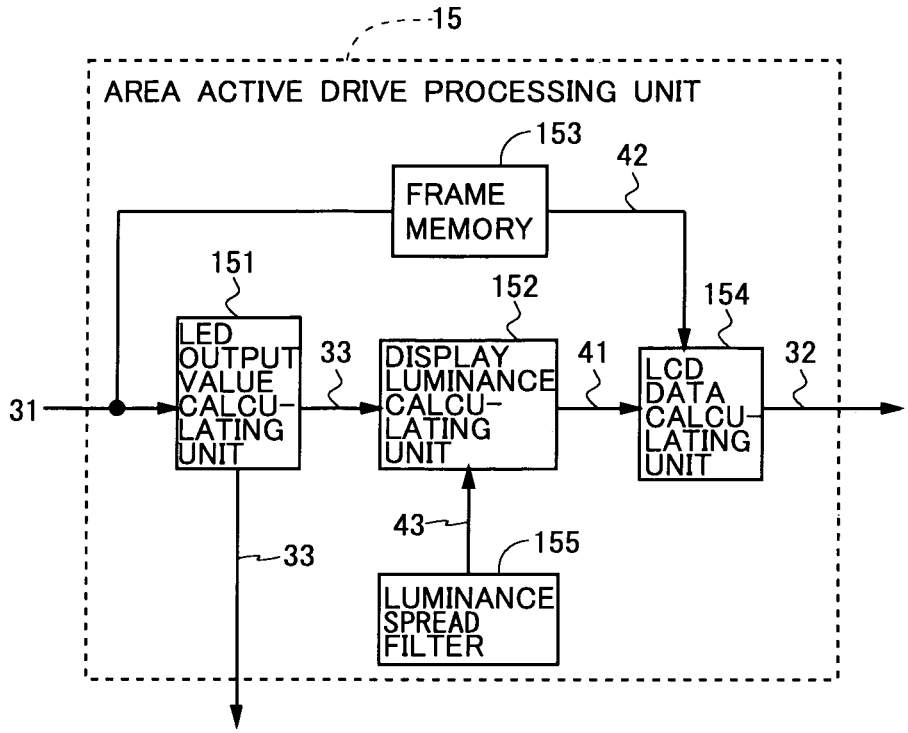
FIG. 3 is a block diagram showing a detailed configuration of an area active drive processing unit in the liquid crystal display device according to the embodiment.

FIG. 3 is a block diagram showing a detailed configuration of the area active drive processing unit 15 in the present embodiment. The area active drive processing unit 15 includes, as components for performing a predetermined process, an LED output value calculating unit 151, a display luminance calculating unit 152, and an LCD data calculating unit 154, and includes, as components for storing predetermined data, a frame memory 153 and a luminance spread filter 155. Note that, in the present embodiment, a light-emission luminance calculating unit is implemented by the LED output value calculating unit 151, and a display data calculating unit is implemented by the LCD data calculating unit 154. Note also that, although these components consist of dedicated hardware, the functions of these components may be implemented by a program installed on hardware such as a predetermined microcomputer or signal processor.

The LED output value calculating unit 151 divides an input image into a plurality of areas and obtains LED data (light-emission luminance data) 33 representing the luminances upon light emission of the LEDs provided for the respective areas. Note that, in the following, the value of the luminance upon light emission of LEDs is referred to as an "LED output value".

The luminance spread filter 155 typically stores PSF (Point Spread Filter) data 43 which is data representing how light spreads by numerical values, in order to calculate display luminances for the respective areas. The display luminance calculating unit 152 obtains a luminance image 41 by performing convolution of the LED data 33 and the PSF data 43 stored in the luminance spread filter 155. Note that the luminance image 41 is subjected to linear interpolation so as to have the same image size as liquid crystal data 32.

The frame memory 153 temporarily stores the input image 31 and holds the input image 31 until computations by the LED output value calculating unit 151 and the display luminance calculating unit 152 complete (until computation time has elapsed). Thereafter, the frame memory 153 provides an input image 42 delayed so as to be simultaneously provided with the corresponding luminance image 41, to the LCD data calculating unit 154.

The LCD data calculating unit 154 obtains liquid crystal data 32 representing the light transmittances of all of the display elements 21 included in the liquid crystal panel 11, based on the input image 42 delayed by the above-described computation time and the corresponding luminance image 41. A detailed configuration of the LCD data calculating unit 154 will be described later.

<3. Processing Procedure of the Area Active Drive Processing Unit>

Figure 4:
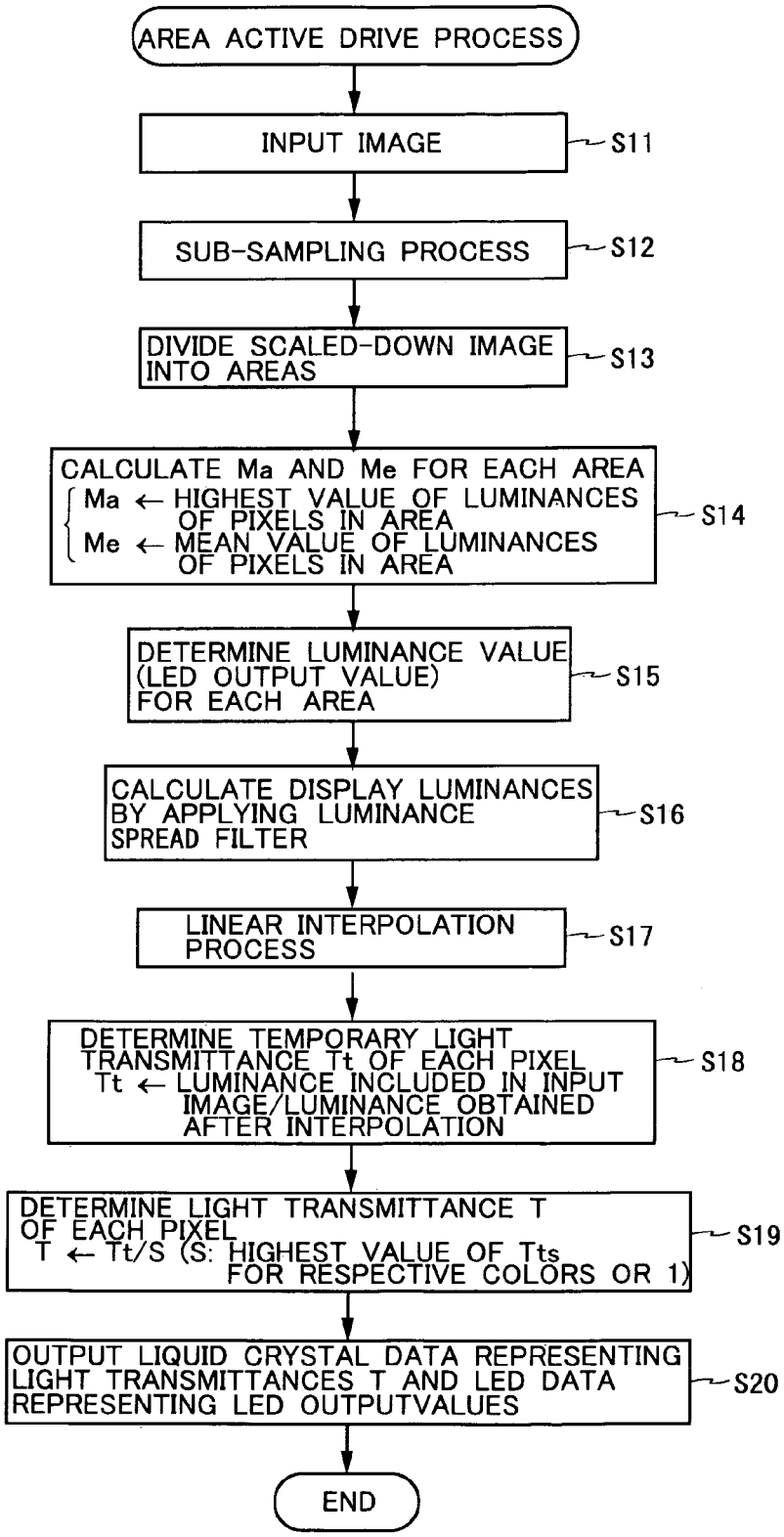
FIG. 4 is a flowchart showing a process of the area active drive processing unit in the embodiment.

FIG. 4 is a flowchart showing a process of the area active drive processing unit 15. An image of a given color component (hereinafter, referred to as the color component C) included in an input image 31 is inputted to the area active drive processing unit 15 (step S11). The input image of the color component C includes the luminances of (m×n) pixels. Note that in the present embodiment, the color components are of three colors RGB, and in practice, this process is simultaneously performed for all of the colors.

Then, the area active drive processing unit 15 performs a sub-sampling process (averaging process) on the input image of the color component C, thereby obtaining a scaled-down image including the luminances of (sp×sq) pixels (s is an integer greater than or equal to 2) (step S12). At step S12, the input image of the color component C is scaled down by a factor of (sp/m) in the horizontal direction and a factor of (sq/n) in the vertical direction. Then, the area active drive processing unit 15 divides the scaled-down image into (p×q) areas (step S13). Each area includes the luminances of (s×s) pixels. Then, the area active drive processing unit 15 determines, for each of the (p×q) areas, a highest value Ma of the luminances of pixels in the area and a mean value Me of the luminances of the pixels in the area (step S14).

Then, the area active drive processing unit 15 determines, for each of the (p×q) areas, an LED output value (the value of the luminance upon light emission of LEDs) (step S15). Methods of determining the LED output value include, for example, a method of determining it based on a highest value Ma of the luminances of pixels in the area, a method of determining it based on a mean value Me of the luminances of pixels in the area, and a method of determining it based on a value obtained by performing weighted averaging of the highest value Ma and mean value Me of the luminances of pixels in the area. Here, even in the case of determining an LED output value based only on a highest value Ma, if the luminances in areas around and adjacent to a corresponding area are low, then the luminances of pixels in the area may not reach the highest value Ma, resulting in the luminances being insufficient. Therefore, even in the case of determining an LED output value based only on a highest value Ma, the problem occurs as well that the luminance ratio between the colors at which display is originally supposed to be performed changes, thereby reducing color reproducibility (changing hue). Note that the processes at steps S11 to S15 are performed by the LED output value calculating unit 151 in the area active drive processing unit 15.

Then, the area active drive processing unit 15 applies the luminance spread filter (point spread filter) 155 to the (p×q)

LED output values determined at step S15, thereby obtaining first backlight luminance data including (tp×tq) display luminances (t is an integer greater than or equal to 2) (step S16). At step S16, the (p×q) LED output values are scaled up by a factor of t in both the horizontal direction and the vertical direction, whereby (tp×tq) display luminances are determined. Note that the process at step S16 is performed by the display luminance calculating unit 152 in the area active drive processing unit 15.

Then, the area active drive processing unit 15 performs a linear interpolation process on the first backlight luminance data, thereby obtaining second backlight luminance data including (m×n) luminances (step S17). At step S17, the first backlight luminance data is scaled up by a factor of (m/tp) in the horizontal direction and a factor of (n/tq) in the vertical direction. The second backlight luminance data represents the luminances of backlight lights of the color component C that enter (m×n) display elements 21 of the color component C when (p×q) LEDs of the color component C emit lights at the luminances determined at step S15. The second backlight luminance data is outputted from the display luminance calculating unit 152, as a luminance image 41. Note that the luminance image 41 is created for the respective colors (one by one in a time-division manner or simultaneously in a parallel manner) and is simultaneously provided to the LCD data calculating unit 154.

Then, the area active drive processing unit 15 divides the luminances of the (m×n) pixels included in the input image of the color component C by the (m×n) luminances included in the second backlight luminance data, respectively, thereby determining temporary light transmittances Tt of the (m×n) display elements 21 of the color component C (step S18). By this, temporary liquid crystal data including (m×n) pixels is generated. Here, it is assumed that there may be a temporary light transmittance Tt exceeding 1. Since the light transmittance of liquid crystals cannot exceed 1, in conventional area active drive, if a value exceeding 1 is calculated, i.e., if a pixel luminance included in the input image of the color component C is higher than a corresponding one in the second backlight luminance data, then in order to prevent the light transmittance T from exceeding 1, a process of rounding the value to 1 is performed. In the present embodiment, however, even if a temporary light transmittance Tt exceeds 1, a process of rounding the value thereof to 1 is not performed.

Then, the area active drive processing unit 15 divides the temporary light transmittances Tt of the (m×n) display elements 21 of the color component C which are determined at step S18, by their respective selected values S, thereby determining light transmittances T of the (m×n) display elements 21 of the color component C (step S19). Here, the selected value S is set as follows. When any of temporary light transmittances Tt for all color components (color components of three RGB colors) forming a given pixel among the (m×n) pixels exceeds 1, the highest value of the three temporary light transmittances Tt is set as the selected value S, and when none of the temporary light transmittances Tt exceeds 1, the selected value S is set to 1. By dividing the temporary light transmittances Tt by such a selected value S, even if any of the temporary light transmittances Tt exceeds 1, color reproducibility can be maintained.

Namely, according to a conventional configuration in which, for example, in order to prevent a light transmittance T from exceeding 1, a process of rounding the value thereof to 1 is performed, when a light transmittance T exceeds 1, only a luminance value for a color to be rounded among luminance values for the respective RGB colors forming one pixel is reduced. Thus, an overall luminance value (combined luminance value) for the three colors is close to a luminance value at which reproduction is supposed to be performed, but since the luminance ratio between the three colors changes, the color reproducibility in the pixel decreases (hue changes). However, according to the above-described configuration of the present embodiment, when any of temporary light transmittances Tt exceeds 1, each of the temporary light transmittances Tt is divided by the highest value thereof, and thus, an overall luminance value (combined luminance value) for the three colors is smaller than a luminance value at which reproduction is supposed to be performed. However, since the luminance ratio between the three colors does not change, the color reproducibility in a corresponding pixel does not decrease (hue does not change). Therefore, an image can be displayed in more natural colors.

Note that the processes at steps S18 and S19 are performed by the LCD data calculating unit 154 in the area active drive processing unit 15. A detailed configuration of such an LCD data calculating unit 154 will be described with reference to FIG. 5.

Figure 5:
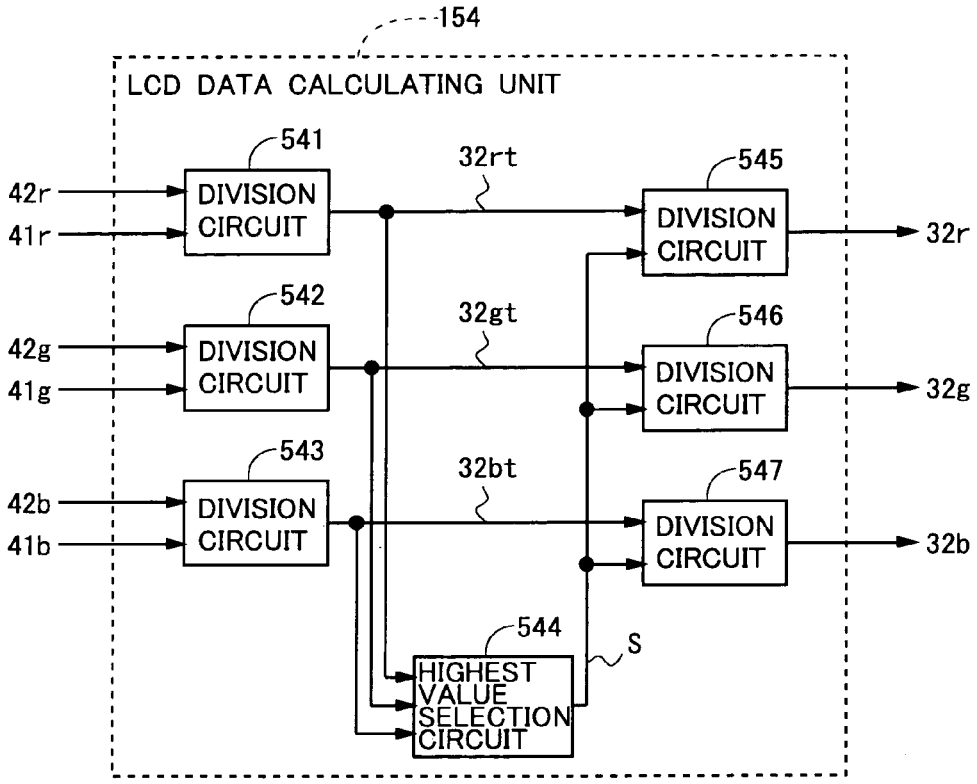
FIG. 5 is a block diagram showing a detailed configuration of an LCD data calculating unit in the embodiment.

FIG. 5 is a block diagram showing a detailed configuration of the LCD data calculating unit. As shown in this FIG. 5, the LCD data calculating unit 154 includes first division circuits 541 to 543, second division circuits 545 to 547, and a highest value selection circuit 544. The first division circuit 541 receives R luminance data 41*r* which is R (red) luminance data in a luminance image 41, and input R luminance data 42*r* which is R (red) luminance data in a delayed input image 42. Positions (pixel positions) in images of these luminance data units are the same. The frame memory 153 performs control to delay data by computation time so that data units in the same position can be simultaneously provided to the LCD data calculating unit 154.

The first division circuit 541 divides the input R luminance data 42*r* by the R luminance data 41*r* and provides an obtained result, as temporary R liquid crystal data 32*rt*, to the second division circuit 545 and the highest value selection circuit 544. Note that this operation was described in detail at step S18.

The above-described operation is also similarly performed for the first division circuits 542 and 543 and for G (green) and B (blue) data, and thus, detailed description thereof is omitted.

The highest value selection circuit 544 compares the temporary R liquid crystal data 32*rt*, temporary G liquid crystal data 32*gt*, and temporary B liquid crystal data 32*bt* which are received from the first division circuits 541 to 543, and selects the highest value. If the selected value exceeds 1, then the value is outputted as a selected value S, and if the selected value is 1 or less, then 1 is outputted as a selected value S. The outputted selected value S is provided to the second division circuits 545 to 547.

The second division circuit 545 divides the temporary R liquid crystal data 32*rt* received from the first division circuit 541 by the selected value S received from the highest value selection circuit 544, and outputs an obtained result as R liquid crystal data 32*r*. Note that the second division circuits 546 and 547 also similarly perform the process for G (green) and B (blue) data, and thus, detailed description thereof is omitted.

The R liquid crystal data 32*r*, G liquid crystal data 32*g*, and B liquid crystal data 32*b* which are calculated in the above-described manner for all of the pixels are provided to the panel drive circuit 12 as liquid crystal data 32, as shown at step S20 which will be described later. Note that in practice, the liquid crystal data 32 is converted into values suitable for the panel drive circuit 12.

Note that the functions of the LCD data calculating unit 154 may be implemented by a program. In that case, the configuration is preferably such that, when a selected value exceeds 1, the highest value selection circuit 544 (a portion of the program corresponding thereto) sets the value as a selected value S, and R liquid crystal data 32*r* is obtained by the second division circuit 545 (a portion of the program corresponding thereto), and when the selected value is 1 or less, temporary R liquid crystal data 32*rt* is used as R liquid crystal data 32*r*. By doing so, the number of processes performed by the second division circuit 545 (a portion of the program corresponding thereto) can be reduced.

Finally, the area active drive processing unit 15 outputs, for each color component, liquid crystal data 32 representing the (m×n) light transmittances determined at step S19, and LED data 33 representing the (p×q) LED output values determined at step S15 (step S20). At this time, the liquid crystal data 32 and the LED data 33 are converted into values in a suitable range, in accordance with the specifications of the panel drive circuit 12 and the backlight drive circuit 14.

The area active drive processing unit 15 performs the process shown in FIG. 4 in the above-described manner on an R image, a G image, and a B image and thereby obtains, based on an input image 31 including the luminances of (m×n×3) pixels, liquid crystal data 32 representing (m×n×3) transmittances and LED data 33 representing (p×q×3) LED output values.

Figure 6:
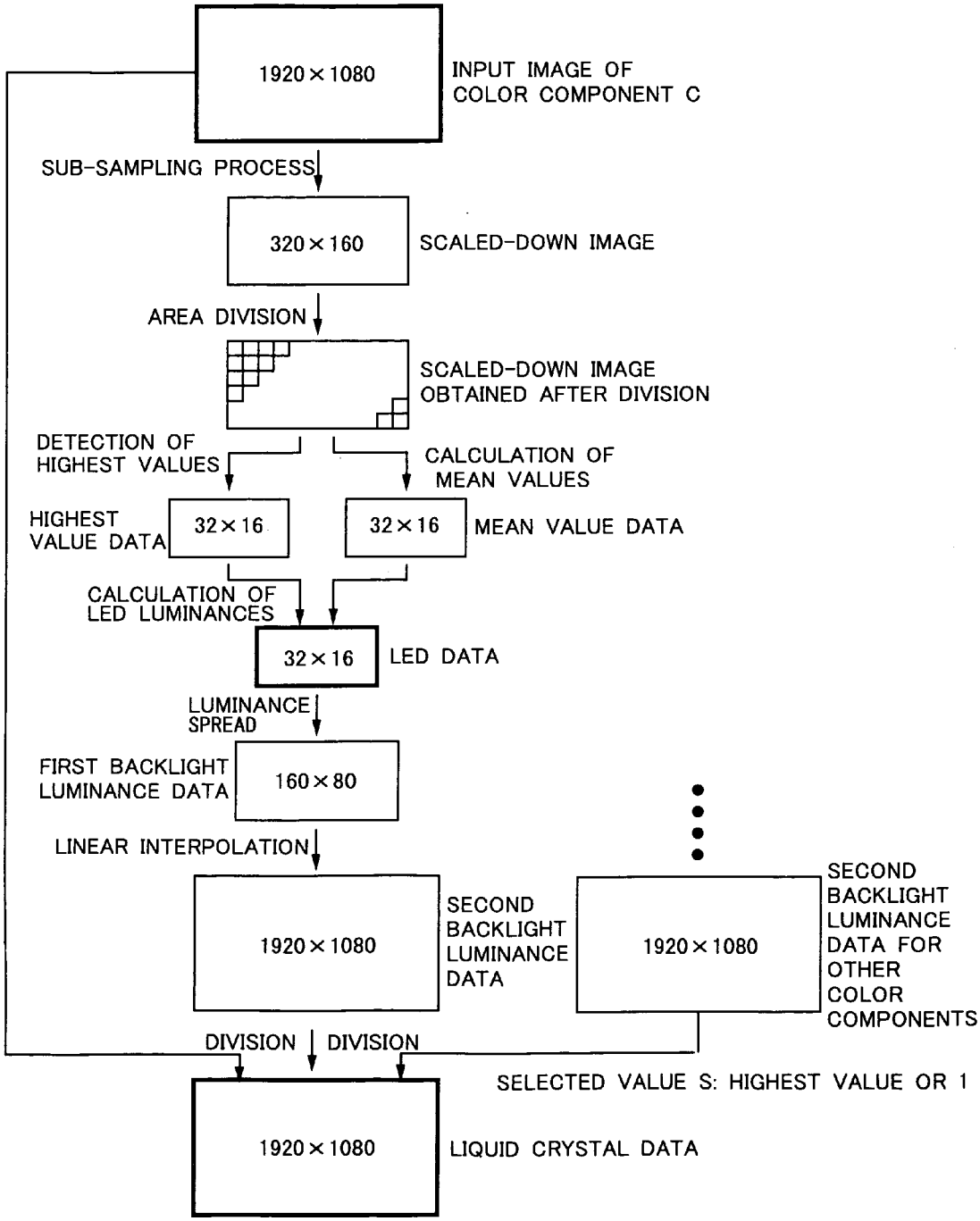
FIG. 6 is a diagram showing the process of obtaining liquid crystal data and LED data in the embodiment.

FIG. 6 is a diagram showing the process of obtaining liquid crystal data and LED data for the case in which m=1920, n=1080, p=32, q=16, s=10, and t=5. As shown in FIG. 6, by performing a sub-sampling process on an input image of a color component C which includes the luminances of (1920×1080) pixels, a scaled-down image including the luminances of (320×160) pixels is obtained. The scaled-down image is divided into (32×16) areas (the area size is (10×10) pixels). By determining the highest value Ma and mean value Me of the luminances of pixels for each area, highest value data including (32×16) highest values and mean value data including (32×16) mean values are obtained. Then, based on the highest value data or the mean value data or based on weighted averaging of the highest value data and the mean value data, LED data for the color component C representing (32×16) LED luminances (LED output values) is obtained.

By applying the luminance spread filter 155 to the LED data for the color component C, first backlight luminance data including (160×80) display luminances is obtained. By applying a correction filter to the first backlight luminance data, correction is performed on the display luminances included in the first backlight luminance data. By performing a linear interpolation process on the first backlight luminance data, second backlight luminance data including (1920×1080) display luminances is obtained.

The above-described process is performed for the respective RGB colors simultaneously in a parallel manner, or in a time-division manner, thereby obtaining second backlight luminance data for all of the RGB colors. Finally, by dividing the luminances of the pixels included in the input image by the display luminances included in the second backlight luminance data, (1920×1080) temporary light transmittances are calculated. Then, when none of temporary light transmittances for the respective RGB colors including the color component C exceeds 1, 1 is set as a selected value. When any of the temporary light transmittances exceeds 1, the highest value thereof is calculated as a selected value S. Then, by dividing the (1920×1080) temporary light transmittances for the color component C by their respective selected values S, (1920×1080) liquid crystal data units for the color component C are obtained.

For example, it is assumed that, in a given pixel included in an input image, the luminance for red is Xr (=60), the luminance for green is Xg (=75), and the luminance for blue is Xb (=80), and the luminance for red in a pixel corresponding to the given pixel that is included in second backlight luminance data is Ar (=100), the luminance for green is Ag (=150), and the luminance for blue is Ab (=70). In this case, a temporary light transmittance for red is Xr/Ar=0.6, a temporary light transmittance for green is Xg/Ag=0.5, and a temporary light transmittance for blue is Xb/Ab=1.142 . . . , and thus, the temporary light transmittance for blue (Xb/Ab) exceeds 1. Therefore, this value is set as a selected value S, resulting in a light transmittance Br for red=0.525 . . . , a light transmittance Bg for green=0.4375 . . . , and a light transmittance Bb for blue=1.0. Thus, the following equation (1) is established:

$$Xr:Xg:Xb=Ar\cdot Br:Ag\cdot Bg:Ab\cdot Bb \quad (1).$$

As such, although the luminance of a display pixel corresponding to a final light transmittance is lower than a luminance at which display is originally supposed to be performed, as shown in the equation (1), the ratio between the RGB colors matches the ratio between the RGB colors at which display is originally supposed to be performed. Hence, the display device can display natural colors with high color reproducibility.

Note that although in FIG. 4 the area active drive processing unit 15 performs a sub-sampling process on an input image to remove noise, and performs area active drive based on a scaled-down image, the area active drive processing unit 15 may perform area active drive based on an original input image.

<4. Effects>

According to the present embodiment, as described above at step S19, when any of temporary light transmittances Tt for all color components (color components of three RGB colors) forming a given pixel exceeds 1, the highest value of the three temporary light transmittances Tt is set as a selected value S, and when none of them exceeds 1, a selected value S is set to 1. Then, the temporary light transmittances Tt are divided by the selected value S. According to this configuration, even when any of temporary light transmittances Tt exceeds 1, display with high color reproducibility can be performed on a display unit.

<5. Others>

Although in the above-described embodiments, the backlight 13 consists of the red LEDs 23, the green LEDs 24, and the blue LEDs 25, the backlight may consist of Cold Cathode Fluorescent Lamps (CCFLs), etc. Also, although the liquid crystal panel 11 consists of multiple display elements 21 including liquid crystals, instead of liquid crystals, shutter elements may be used that are formed of a known material having an electro-optical characteristic that allows to control the transmittances of lights from the backlight 13.

Although in the above-described embodiments, each LED unit 22 includes one red LED 23, one green LED 24, and one blue LED 25, the number of LEDs of the three colors included in each LED unit 22 may be other than that. For example, each LED unit 22 may include one red LED 23, one blue LED 25, and two green LEDs 24. In this case, the backlight drive circuit 14 controls the two green LEDs 24 such that the sum of the luminances of the two green LEDs 24 is an LED luminance determined at step S15. Alternatively, a configuration including a white LED in addition to the three colors may be employed. With this configuration, a phenomenon which occurs when any of temporary light transmittances Tt exceeds 1 and in which an overall luminance value (combined luminance value) for the three colors is smaller than a luminance value at which reproduction is supposed to be performed, can be overcome by increasing the luminance of the white LED by an amount corresponding to the reduction. Alternatively, the configuration may be such that LEDs that emit a plurality of primary colors other than the above-described three or four colors are appropriately combined.

In the above-described embodiment, when any of temporary light transmittances Tt for the respective colors exceeds 1, the temporary light transmittances Tt are divided by the highest value thereof, but the temporary light transmittances Tt do not necessarily need to be divided by the highest value of the temporary light transmittances Tt, and a predetermined value larger than the highest value may be used. By doing so, light transmittances T do not exceed 1 and the luminance ratio between the three colors does not change. Thus, even if the combined luminance for the colors in a corresponding pixel decreases, color reproducibility does not decrease. Accordingly, an image can be displayed in more natural colors. Note that, even if the predetermined value is smaller than the highest value, the effect of suppressing a reduction in color reproducibility can be provided.

INDUSTRIAL APPLICABILITY

The present invention is to be applied to image display devices having a backlight device including light sources that emit a plurality of primary colors, and is suitably used for image display devices such as liquid crystal display devices having the function of controlling the luminance of a backlight (backlight dimming function).

DESCRIPTION OF REFERENCE NUMERALS

10: LIQUID CRYSTAL DISPLAY DEVICE
11: LIQUID CRYSTAL PANEL
12: PANEL DRIVE CIRCUIT
13: BACKLIGHT
14: BACKLIGHT DRIVE CIRCUIT
15: AREA ACTIVE DRIVE PROCESSING UNIT
21: DISPLAY ELEMENT
22: LED UNIT
31: INPUT IMAGE
32: LIQUID CRYSTAL DATA
33: LED DATA
41: LUMINANCE IMAGE
42: DELAYED INPUT IMAGE
43: PSF DATA
151: LED OUTPUT VALUE CALCULATING UNIT
152: DISPLAY LUMINANCE CALCULATING UNIT
153: FRAME MEMORY
154: LCD DATA CALCULATING UNIT
155: LUMINANCE SPREAD FILTER
541 to 543: FIRST DIVISION CIRCUIT
545 to 547: SECOND DIVISION CIRCUIT
544: HIGHEST VALUE SELECTION CIRCUIT

The invention claimed is:

1. An image display device having a function of controlling a luminance of a backlight, the image display device comprising:

a backlight including a plurality of light sources that emit lights which are a plurality of primary colors;

a display panel including a plurality of sets of a plurality of display elements, each set displaying one pixel in a plurality of colors by allowing lights from the light sources to be transmitted therethrough;

a light-emission luminance calculating unit that divides an input image into a plurality of areas and obtains light-emission luminance data based on the input image, the input image including a plurality of pixels, each of which is formed by a plurality of colors, the light-emission luminance data representing luminances upon light emission of the light sources provided for the respective areas;

a display luminance calculating unit that determines display luminances based on the light-emission luminance data for the respective areas, the display luminances being highest luminances obtained by the respective display elements;

a display data calculating unit that obtains display data for controlling light transmittances of the display elements, based on the input image and the display luminances determined by the display luminance calculating unit;

a panel drive circuit that outputs, based on the display data, signals for controlling the light transmittances of the display elements to the display panel; and a backlight drive circuit that outputs, based on the light-emission luminance data, signals for controlling luminances of the light sources to the backlight, wherein when any of luminances for the respective colors forming a pixel in the input image is higher than a corresponding display luminance, the display data calculating unit obtains the display data based on values obtained by dividing each of the luminances for the respective colors forming the pixel in the input image by a same value, so that a light transmittance of a corresponding display element is 1 or less.

2. The image display device according to claim 1, wherein the display data calculating unit divides luminances for the respective colors forming a pixel in the input image by corresponding display luminances for the respective colors of the pixel, thereby calculating temporary light transmittances for the respective colors, and when a highest value of the temporary light transmittances for the respective colors exceeds 1, the display data calculating unit divides each of the temporary light transmittances for the respective colors by the highest value, thereby calculating light transmittances for the respective colors, and when the highest value is 1 or less, the display data calculating unit calculates the temporary light transmittances for the respective colors as light transmittances for the respective colors.

3. The image display device according to claim 2, wherein the display data calculating unit includes:

a first division circuit that outputs the temporary light transmittances for the respective colors which are obtained by dividing luminances for the respective colors forming a pixel in the input image by corresponding display the luminances for the respective colors of the pixel;

a highest value selection circuit that selects a highest value of the temporary light transmittances for the respective colors which are outputted from the first division circuit, and outputs the highest value as a selected value when the highest value exceeds 1, and outputs 1 as a selected value when the highest value is 1 or less; and a second division circuit that outputs the light transmittances for the respective colors which are obtained by dividing each of the temporary light transmittances for the respective colors which are outputted from the first division circuit by the selected value outputted from the highest value selection circuit.

4. The image display device according to claim 1, wherein the backlight includes light sources that respectively emit red, green, and blue which are three primary colors of light, and the display panel includes display elements that respectively control transmittances of red, green, and blue lights emitted from the light sources.

5. The image display device according to claim 4, wherein the display panel includes liquid crystal elements as the display elements.

6. An image control display method for an image display device having a function of controlling a luminance of a backlight, and having a backlight including a plurality of light sources that emit lights which become a plurality of primary colors; and a display panel including a plurality of sets of a plurality of display elements, each set displaying one pixel in a plurality of colors by allowing lights from the light sources to be transmitted therethrough, the method comprising:

a light-emission luminance calculating step of dividing an input image into a plurality of areas and obtaining light-emission luminance data based on the input image, the input image including a plurality of pixels, each of which is formed by a plurality of colors, the light-emission luminance data representing luminances upon light emission of the light sources provided for the respective areas;

a display luminance calculating step of determining display luminances based on the light-emission luminance data for the respective areas, the display luminances being highest luminances obtained by the respective display elements;

a display data calculating step of obtaining display data for controlling light transmittances of the display elements, based on the input image and the display luminances determined in the display luminance calculating step;

a panel driving step of causing the display panel to control the light transmittances of the display elements, based on the display data; and a backlight driving step of causing the backlight to control luminances of the light sources, based on the light-emission luminance data, wherein in the display data calculating step, when any of luminances for the respective colors forming a pixel in the input image is higher than a corresponding display luminance, the display data is obtained based on values obtained by dividing each of the luminances for the respective colors forming the pixel in the input image by a same value, so that a light transmittance of a corresponding display element is 1 or less.

7. The image display method according to claim 6, wherein in the display data calculating step, the luminances for the respective colors forming a pixel in the input image are divided by corresponding display luminances for the respective colors of the pixel, thereby calculating temporary light transmittances for the respective colors, and when a highest value of the temporary light transmittances for the respective colors exceeds 1, each of the temporary light transmittances for the respective colors is divided by the highest value, thereby calculating light transmittances for the respective colors, and when the highest value is 1 or less, the temporary light transmittances for the respective colors are calculated as light transmittances for the respective colors.

8. The image display method according to claim 7, wherein the display data calculating step includes:

a first division step of outputting the temporary light transmittances for the respective colors which are obtained by dividing the luminances for the respective colors forming a pixel in the input image by corresponding display luminances for the respective colors of the pixel;

a highest value selecting step of selecting a highest value of the temporary light transmittances for the respective colors which are outputted in the first division step, and outputting the highest value as a selected value when the highest value exceeds 1, and outputting 1 as a selected value when the highest value is 1 or less; and a second division step of outputting light transmittances for the respective colors which are obtained by dividing each of the temporary light transmittances for the respective colors which are outputted in the first division step by the selected value outputted in the highest value selecting step.

* * * * *